US008757967B2

(12) United States Patent
Haller et al.

(10) Patent No.: US 8,757,967 B2
(45) Date of Patent: Jun. 24, 2014

(54) AXIAL FLOW TURBINE

(75) Inventors: Brian Robert Haller, Market Rasen (GB); Gursharanjit Singh, Punjab (IN)

(73) Assignee: Alstom Technology Ltd, Baden (CH)

( * ) Notice: Subject to any disclaimer, the term of this patent is extended or adjusted under 35 U.S.C. 154(b) by 300 days.

(21) Appl. No.: 13/356,088

(22) Filed: Jan. 23, 2012

(65) Prior Publication Data

US 2012/0189441 A1 Jul. 26, 2012

(30) Foreign Application Priority Data

Jan. 21, 2011 (EP) ..... 11151614

(51) Int. Cl.
*F01D 1/02* (2006.01)

(52) U.S. Cl.
USPC ..... 415/191; 415/208.2; 416/223 A; 416/243; 416/DIG. 5

(58) Field of Classification Search
USPC ..... 416/223 R, 243, DIG. 2, DIG. 5, 223 A; 415/191, 192, 208.1, 208.2
See application file for complete search history.

(56) References Cited

U.S. PATENT DOCUMENTS

2003/0215330 A1* 11/2003 Haller ..... 415/191

FOREIGN PATENT DOCUMENTS

| | | | |
|---|---|---|---|
| EP | 0 985 801 | A2 | 3/2000 |
| EP | 1 422 382 | A1 | 5/2004 |
| JP | 2004263679 | A * | 9/2004 |

OTHER PUBLICATIONS

Search Report issued on Jun. 28, 2011, by European Patent Office for Application No. 11151614.2.

* cited by examiner

*Primary Examiner* — Edward Look
*Assistant Examiner* — Danielle M Christensen
(74) *Attorney, Agent, or Firm* — Buchanan Ingersoll & Rooney PC

(57) ABSTRACT

An axial flow turbine includes in axial flow series a low pressure turbine section and a turbine exhaust system. The low pressure turbine section includes a final low pressure turbine stage having a circumferential row of static aerofoil blades followed in axial succession by a circumferential row of rotating aerofoil blades. Each aerofoil blade has a radially inner hub region and a radially outer tip region. The K value, being equal to the ratio of the throat dimension (t) to the pitch dimension (p), of each static aerofoil blade of the final low pressure turbine stage varies along the height of the static aerofoil blade, between the hub region and the tip region, according to a substantially W-shaped distribution.

12 Claims, 4 Drawing Sheets

AXIAL FLOW TURBINE

RELATED APPLICATION(S)

This application claims priority under 35 U.S.C. §119 to European Patent Application No. 11151614.2 filed in Europe on Jan. 21, 2011, the entire content of which is hereby incorporated by reference in its entirety.

FIELD

The present disclosure relates to an axial flow turbine and, for example, to an axial flow steam turbine having increased efficiency as a result of design of the aerofoil blades within a final low pressure turbine stage of the steam turbine.

BACKGROUND INFORMATION

Steam turbines used for power generation can include high pressure, optional intermediate pressure and low pressure turbine sections arranged in axial flow series and each section having a series of turbine stages. The pressure and temperature of the steam decreases as the steam is expanded through the turbine stages in each turbine section and, after expansion through the final stage of the low pressure turbine section, the steam can be discharged through a turbine exhaust system.

Steam turbine efficiency is desirable, for example, in large power generation installations where a fractional increase in efficiency can result in a reduction in an amount of fuel that is used to produce electrical power. This can lead to cost savings and lower emissions of $CO_2$, with corresponding reductions of SOx and NOx.

A final low pressure turbine stage and a turbine exhaust system can both have an influence on performance, and hence overall efficiency, of steam turbines. Aerofoil blade designs employed in the final low pressure turbine stage of known steam turbines can generate a large amount of leaving energy and a non-uniform stagnation pressure distribution, both of which can be detrimental to the overall performance of the final low pressure turbine stage and turbine exhaust system.

In exemplary embodiments, it is desirable if the final low pressure turbine stage delivers a minimal amount of leaving energy to the turbine exhaust system and generates a stagnation pressure distribution at an inlet to the turbine exhaust system which is nearer an ideal. This ideal pressure distribution is substantially constant across a height of the aerofoil blades in the final low pressure turbine stage and increases slightly towards the tip region.

Aerofoil blades having an increased radial height, between a hub region and a tip region, have been employed in an attempt to reduce the leaving energy of the final low pressure turbine stage and, hence, to increase efficiency of the final low pressure turbine stage. However, this can lead to turbine exhaust systems in which a ratio of an exhaust system axial length (L) to a height (H) of rotating aerofoil blades (i.e. L/H) of the final low pressure turbine stage is much reduced. It can be undesirable to increase the axial length (L) of the turbine exhaust system for a number of reasons, for example, because any reduction in a compactness of the steam turbine can significantly increase its footprint and, hence, installation cost.

The following exemplary definitions will be used throughout this specification.

The radially innermost extremity of an aerofoil blade, whether it is a static aerofoil blade or a rotating aerofoil blade, can be referred to as its "hub region" (also commonly known as the root) whilst the radially outermost extremity of an aerofoil blade, whether it is a static aerofoil blade or a rotating aerofoil blade, can be referred to as its "tip region".

The "pressure surface" of an aerofoil blade can be its concave side and the "suction surface" can be its convex side.

The blade outlet angle ($\alpha$) of an aerofoil blade can be the angle, relative to a circumferential direction of a rotor, that a working fluid leaves a circumferential blade row and is derived from the relationship:—

$$\alpha=\sin^{-1} K$$

where:

K=throat dimension(t)/pitch dimension(p)

A throat dimension (t) can be defined as a shortest line extending from one aerofoil blade trailing edge normal to the suction surface of an adjacent aerofoil blade in a same row, whereas a pitch dimension (p) can be a circumferential distance from one aerofoil blade trailing edge to an adjacent aerofoil blade trailing edge in a same row at a specified radial distance from the hub region of the aerofoil blade.

The expression $AN^2$ can represent a product of an area (A) of an annulus swept by the rotating aerofoil blades of the final low pressure turbine stage at the outlet of the low pressure turbine section, multiplied by a square of a rotational speed (N) of the rotating aerofoil blades. The annulus area (A) can be defined as a difference in area of the circles delineated by the inner and outer radii of the rotating aerofoil blades.

The "axial width" (W) of an aerofoil blade can be the axial distance between its leading and trailing edges (for example, the distance between its leading and trailing edges as measured along the rotational axis of the turbine).

SUMMARY

An axial flow turbine is disclosed comprising a low pressure turbine section and a turbine exhaust system in axial flow series with the low pressure turbine section, the low pressure turbine section comprising a final low pressure turbine stage having a circumferential row of static aerofoil blades followed in axial succession by a circumferential row of rotating aerofoil blades, each aerofoil blade having a radially inner hub region and a radially outer tip region, wherein a K value, being equal to a ratio of a throat dimension (t) to a pitch dimension (p), of each static aerofoil blade varies along a height of the static aerofoil blade, between the hub region and the tip region, according to a substantially W-shaped distribution.

DETAILED DESCRIPTION

Figure 1:
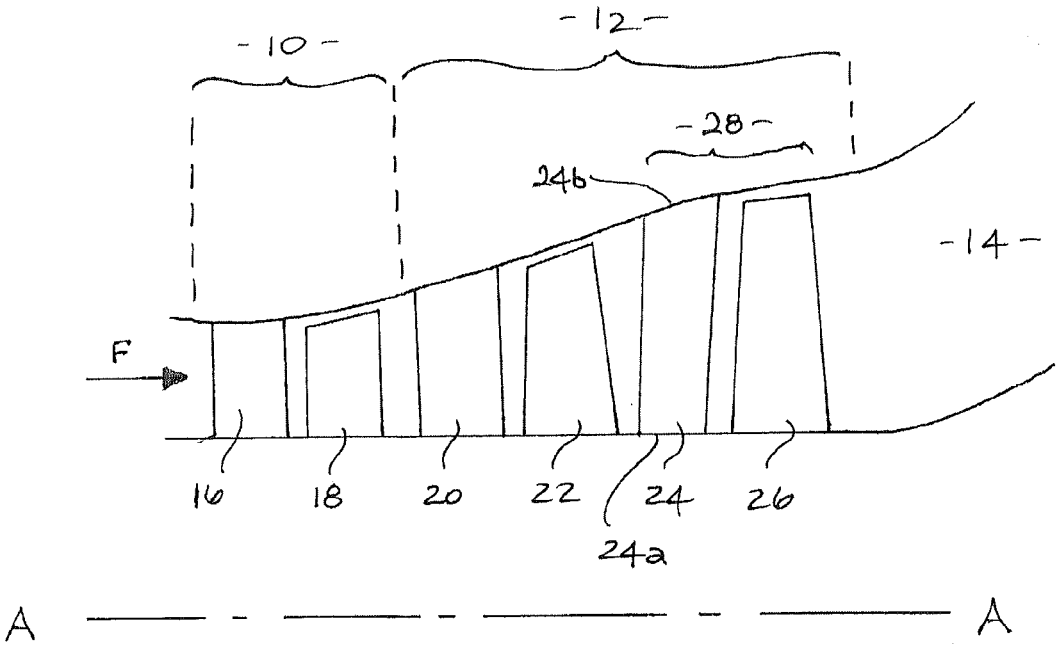
FIG. 1 is a diagrammatic axial sectional view through the flow path of an axial flow turbine according to an exemplary embodiment of the disclosure.

According to an exemplary embodiment of the present disclosure, there is provided an axial flow turbine including, in axial flow series, a low pressure turbine section and a turbine exhaust system. The low pressure turbine section includes a final low pressure turbine stage including a circumferential row of static aerofoil blades followed in axial succession by a circumferential row of rotating aerofoil blades. Each aerofoil blade has a radially inner hub region and a radially outer tip region. The K value, equal to the ratio of the throat dimension (t) to the pitch dimension (p) of each static aerofoil blade varies along the height of the static aerofoil blade, between the hub region and the tip region, according to a substantially W-shaped distribution.

The axial flow turbine can be, for example, a steam turbine.

By adopting a substantially W-shaped distribution for the K value, the leaving energy delivered by the final low pressure turbine stage to the turbine exhaust system can be minimised. A closer to ideal pressure distribution can also be provided at the inlet to the exhaust system, for example, a substantially uniform radial pressure distribution across the height of the aerofoil blades which increases slightly towards the tip region.

An improvement in the total-to-total efficiency of the final low pressure turbine stage can be achieved at low exhaust velocity conditions, for example around (e.g. ±10%) 125 m/s, without a substantial decrease in the total-to-total efficiency at high exhaust velocity conditions, for example around (e.g. ±10%) 300 m/s. This can be advantageous as the total-to-total efficiency of the final low pressure turbine stage of known steam turbines can decrease rapidly at an exhaust velocity below about (e.g. ±10%) 170 m/s. Adequate performance of the final low pressure turbine stage of known steam turbines can normally not be guaranteed at an exhaust velocity below about (e.g. ±10%) 150 m/s.

The K value of each static aerofoil blade can vary along the height of the static aerofoil blade between the values $K_{stat\ min}$ and $K_{stat\ max}$ defined in Table 1 below to provide the substantially W-shaped distribution of the K value.

An exemplary optimum K value of each static aerofoil blade $K_{stat\ opt}$ can vary along the height of the static aerofoil blade according to the substantially W-shaped distribution of the K value defined in Table 2 below. The values $K_{stat\ min}$ and $K_{stat\ max}$ at a given height along the static aerofoil blade can be equal to the optimum value $K_{stat\ opt}$±0.1.

Each static aerofoil blade can have a trailing edge lean angle of between 16 degrees and 25 degrees. Each static aerofoil blade can have a trailing edge lean angle of about 19 degrees. In exemplary embodiments according to the disclosure, the trailing edge lean angle can be 19.2 degrees.

In exemplary embodiments according to the disclosure, each static aerofoil blade can include a plurality of radially adjacent aerofoil sections which can be stacked on a straight line along the trailing edge of the static aerofoil blade. In exemplary embodiments according to the disclosure, the aerofoil sections can be stacked on a straight line along the leading edge of the static aerofoil blade or along a straight line through a centroid of the static aerofoil blade. Other stacking arrangements are, of course, entirely within the scope of the disclosure.

Each static aerofoil blade can have a variable aerofoil cross-section along the height of the static aerofoil blade, between the hub region and the tip region.

The K value of each rotating aerofoil blade can vary along the height of the rotating aerofoil blade between the values $K_{rot\ min}$ and $K_{rot\ max}$ defined in Table 3 below to provide a desired distribution of the K value. The optimum K value of each rotating aerofoil blade $K_{rot\ opt}$ can vary along the height of the rotating aerofoil blade according to the K value distribution defined in Table 4 below. The values $K_{rot\ min}$ and $K_{rot\ max}$ at a given height along the rotating aerofoil blade are equal to the optimum value $K_{rot\ opt}$±0.1.

The optimum distribution $K_{rot\ opt}$ defined in Table 4 for each rotating aerofoil blade complements the optimum substantially W-shaped distribution $K_{stat}$ opt defined in Table 2 for each static aerofoil blade. Such an arrangement optimises fluid flow through the final low pressure turbine stage across the radial height of the aerofoil blades.

Each rotating aerofoil blade can taper in the radial direction between a maximum axial width at the hub region and a minimum axial width at the tip region.

Exemplary embodiments of the present disclosure will now be described by way of example only and with reference to the accompanying drawings.

There is shown in FIG. 1 a diagrammatic axial sectional view through the flow path of a steam turbine according to an exemplary embodiment of the disclosure. The direction of flow F of the working fluid, for example, steam, through the annular flow path can be substantially parallel to the turbine rotor axis A-A. The illustrated steam turbine includes, in axial flow series, a high pressure (HP) turbine section 10, a low pressure (LP) turbine section 12 and an exhaust system 14. An intermediate pressure (IP) turbine section could be provided in other exemplary embodiments. The steam turbine operates in a known manner with steam being expanded through the HP and LP turbine sections 10, 12 before finally being discharged through the turbine exhaust section 14 to a condenser.

The HP turbine section 10 includes a circumferential row of static aerofoil blades 16 followed in axial succession by a circumferential row of rotating aerofoil blades 18. The circumferential rows of static aerofoil blades 16 and rotating aerofoil blades 18 together form a HP turbine stage. Only a single HP turbine stage is shown in the HP turbine section 10 for clarity purposes, although in practice multiple HP turbine stages can be provided.

The LP turbine section 12 includes two circumferential rows of static aerofoil blades 20, 24 each of which is followed, in axial succession, by a respective circumferential row of rotating aerofoil blades 22, 26. The axially successive circumferential rows of static aerofoil blades and rotating aerofoil blades 20 and 22, 24 and 26 each form LP turbine stages. The LP turbine stage formed by the circumferential rows of static aerofoil blades 24 and rotating aerofoil blades 26 is the final LP turbine stage 28. Steam flowing along the annular flow path is delivered from the final LP turbine stage 28 to the turbine exhaust system 14. Although only two LP turbine stages are shown in the LP turbine section 12 for clarity purposes, a greater number of LP turbine stages can be provided.

As indicated above, steam delivered by the final LP turbine stage 28 to the turbine exhaust system 14 should, for exemplary embodiments, have ideal flow characteristics in order to maximise the operational efficiency of the steam turbine. In a steam turbine having a hub diameter of about 2.03 meters (80 inches) at the axial position at which the rotating aerofoil blades 26 of the final LP turbine stage 28 are mounted, in which the height of the rotating aerofoil blades 26 is about 1.27 meters (50 inches) and the rotational speed is 3,000 rev/min, ideal flow characteristics have been difficult to achieve using known approaches due to the large diameter ratio and large value of the parameter $AN^2$. Exemplary embodiments of the present disclosure can enable the flow characteristics to be optimised by providing a substantially W-shaped distribution of the K value along the height of the static aerofoil blades 24 of the final LP turbine stage 28 between the hub region 24*a* and the tip region 24*b*.

Figure 2:
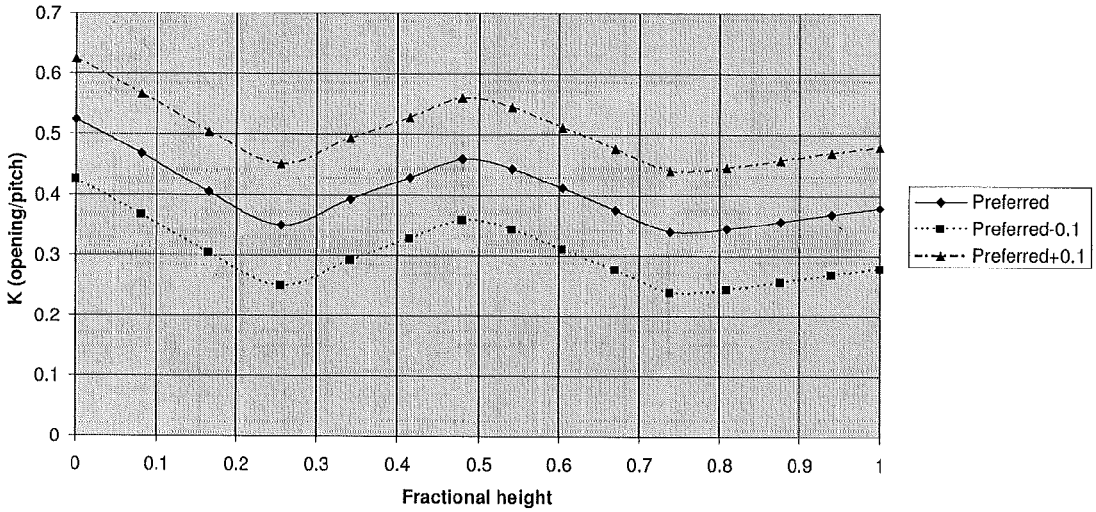
FIG. 2 is a graph showing the variation of the K value against the height of a static aerofoil blade of the final low pressure turbine stage of an axial flow turbine according to an exemplary embodiment of the disclosure.

An exemplary, substantially W-shaped, distribution of the K value ($K_{stat\ opt}$) for the static aerofoil blades 24 of the final LP turbine stage 28 of the above steam turbine is defined in Table 2 below and illustrated graphically in FIG. 2. Although this K value distribution provides optimum steam flow characteristics from the final LP turbine stage 28 into the turbine exhaust system 14, the value $K_{stat\ opt}$ at a given radial height along each static aerofoil blade 24 can be varied by ±0.1, for example to give the substantially W-shaped distributions $K_{stat\ min}$ and $K_{stat\ max}$ defined in Table 1 below and also illustrated graphically in FIG. 2.

Figure 3:
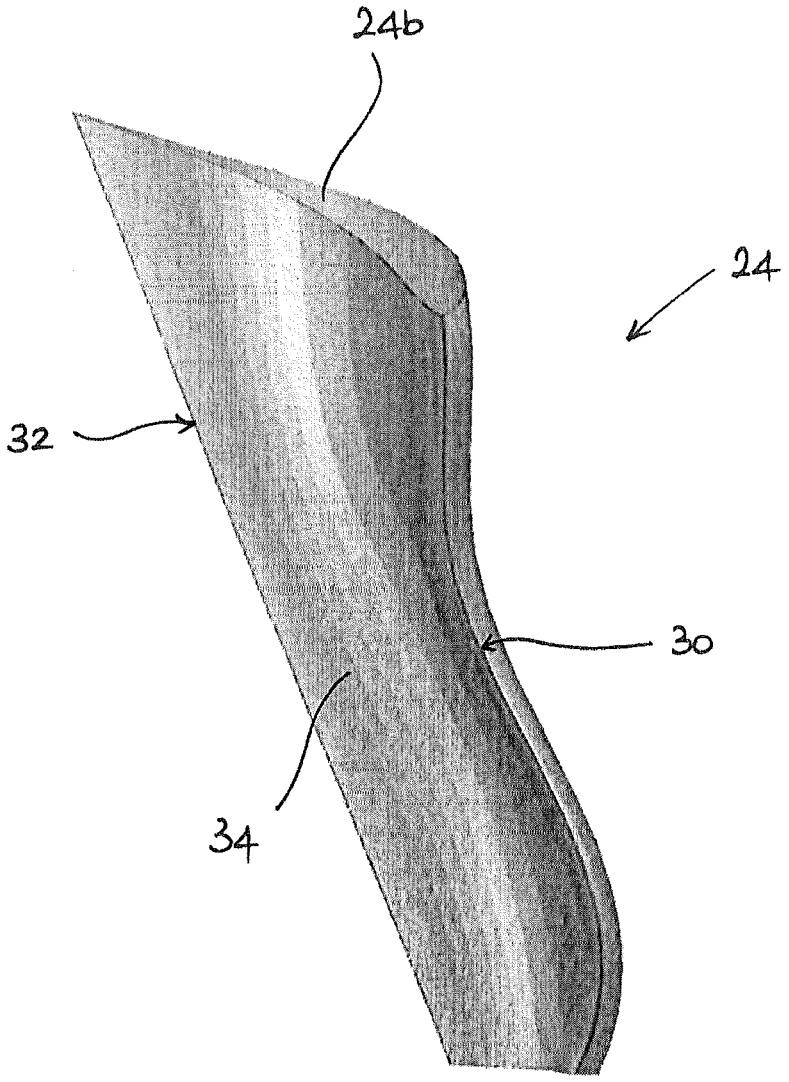
FIG. 3 is a diagrammatic perspective view of part of a static aerofoil blade having a W-shaped distribution of the K value along the height of the static aerofoil blade, in which contours of static pressure on the blade are also indicated according to an exemplary embodiment of the disclosure.

Referring to FIG. 3, which illustrates an exemplary embodiment of part of one of the static aerofoil blades 24 of the final LP turbine stage 28 in which the K value varies in accordance with the substantially W-shaped distribution $K_{stat\ opt}$ defined in Table 2 below, and in which the leading edge 30 therefore has a substantially W-shaped geometric profile, it will be seen that the pressure contours (illustrated schematically by the variable shading) indicate a substantially uniform pressure distribution on the pressure surface 34 of the static aerofoil blade 24 along the trailing edge 32 in the radial direction. This uniform radial pressure distribution, along with the minimised leaving energy, which are provided by the substantially W-shaped distribution of the K value can result in an improved total-to-static efficiency and total-to-total efficiency of the final LP turbine stage 28 and, hence, an improvement in the overall efficiency of the steam turbine.

The static aerofoil blades 24 are formed by a plurality of radially stacked aerofoil sections which have variable cross-section along the height of the static aerofoil blade 24 between the hub region 24*a* and the tip region 24*b*. In the exemplary embodiment of the disclosure described with reference to FIG. 2 and illustrated in FIG. 3, it will be appreciated that the aerofoil sections are stacked on a straight line along the trailing edge 32 of the static aerofoil blade 24. The static aerofoil blade 24 also has a trailing edge lean angle of about (e.g., ±10%) 19.2 degrees, although it can in practice vary between about 16 degrees and 25 degrees.

Figure 4:
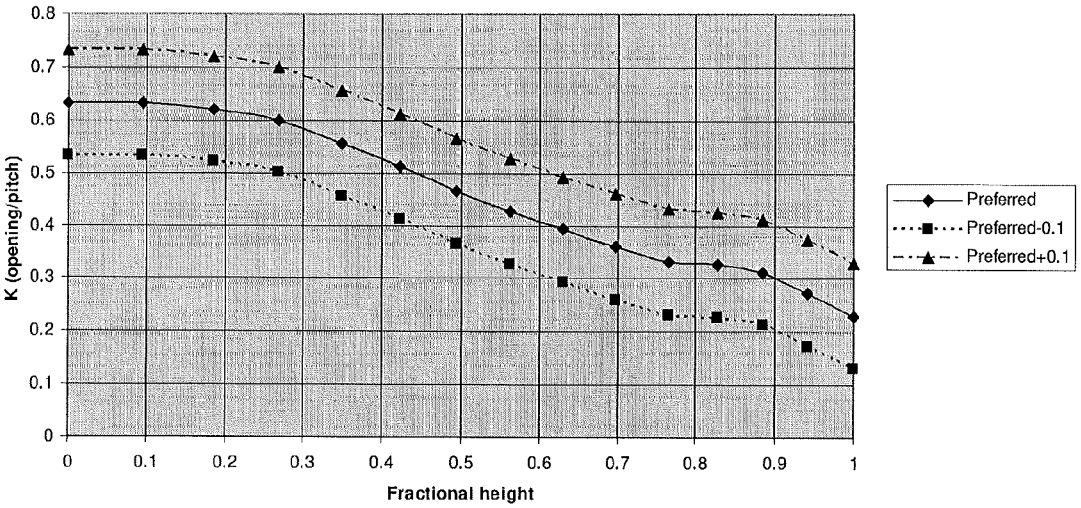
FIG. 4 is a graph showing a variation of the K value against the height of a rotating aerofoil blade of the final low pressure turbine stage of an axial flow turbine according to an exemplary embodiment of the disclosure.

In order to complement the substantially W-shaped distribution of the K value along the height of the static aerofoil blades 24 of the final LP turbine stage 28, the K value of the rotating aerofoil blades 26 of the final LP turbine stage 28 can be optimised so that the steam delivered from the rotating aerofoil blades 26 to the exhaust system 14 has desirable flow characteristics. An exemplary distribution of the K value ($K_{rot\ opt}$) is defined in Table 4 below and illustrated graphically in FIG. 4. Although this distribution provides desirable steam flow characteristics at the exit from the final LP turbine stage 28 into the turbine exhaust system 14, the value $K_{rot\ opt}$ at a given radial height along each rotating aerofoil blade 26 can be varied by ±0.1, for example to give the distributions $K_{rot\ min}$ and $K_{rot\ max}$ defined in Table 3 below and also illustrated graphically in FIG. 4.

TABLE 1

| Fractional height of fixed aerofoil blade | Minimum K value ($K_{stat\ min}$) | Maximum K value ($K_{stat\ max}$) |
|---|---|---|
| 0 | 0.423985906 | 0.623985906 |
| 0.080855998 | 0.36638664 | 0.56638664 |
| 0.165294716 | 0.303545296 | 0.503545296 |
| 0.255880075 | 0.250207381 | 0.450207381 |
| 0.34182611 | 0.292337117 | 0.492337117 |
| 0.4154889 | 0.327357863 | 0.527357863 |
| 0.480483625 | 0.358649554 | 0.558649554 |
| 0.541802843 | 0.343071191 | 0.543071191 |

TABLE 1-continued

| Fractional height of fixed aerofoil blade | Minimum K value ($K_{stat\ min}$) | Maximum K value ($K_{stat\ max}$) |
|---|---|---|
| 0.604115243 | 0.311514359 | 0.511514359 |
| 0.669284849 | 0.276224263 | 0.476224263 |
| 0.738563225 | 0.24037955 | 0.44037955 |
| 0.808859552 | 0.245298199 | 0.445298199 |
| 0.875782568 | 0.256737999 | 0.456737999 |
| 0.939306658 | 0.268124553 | 0.468124553 |
| 1 | 0.27945616 | 0.47945616 |

TABLE 2

| Fractional height of fixed aerofoil blade | Optimum K value ($K_{stat\ opt}$) |
|---|---|
| 0 | 0.523985906 |
| 0.080855998 | 0.46638664 |
| 0.165294716 | 0.403545296 |
| 0.255880075 | 0.350207381 |
| 0.34182611 | 0.392337117 |
| 0.4154889 | 0.427357863 |
| 0.480483625 | 0.458649554 |
| 0.541802843 | 0.443071191 |
| 0.604115243 | 0.411514359 |
| 0.669284849 | 0.376224263 |
| 0.738563225 | 0.34037955 |
| 0.808859552 | 0.345298199 |
| 0.875782568 | 0.356737999 |
| 0.939306658 | 0.368124553 |
| 1 | 0.37945616 |

TABLE 3

| Fractional height of rotating aerofoil blade | Minimum K value ($K_{rot\ min}$) | Maximum K value ($K_{rot\ max}$) |
|---|---|---|
| 0 | 0.533380873 | 0.733380873 |
| 0.09567811 | 0.532029303 | 0.732029303 |
| 0.184560236 | 0.52114778 | 0.72114778 |
| 0.26857315 | 0.500420225 | 0.700420225 |
| 0.34765811 | 0.456295616 | 0.656295616 |
| 0.422040472 | 0.412042865 | 0.612042865 |
| 0.49296063 | 0.364842046 | 0.564842046 |
| 0.561839055 | 0.327357863 | 0.527357863 |
| 0.62991252 | 0.292337117 | 0.492337117 |
| 0.697450866 | 0.259996808 | 0.459996808 |
| 0.763918976 | 0.232161132 | 0.432161132 |
| 0.826696063 | 0.225568154 | 0.425568154 |
| 0.884643622 | 0.212334919 | 0.412334919 |
| 0.94136252 | 0.172280247 | 0.372280247 |
| 1 | 0.130049737 | 0.330049737 |

TABLE 4

| Fractional height of rotating aerofoil blade | Optimum K value ($K_{rot\ opt}$) |
|---|---|
| 0 | 0.633380873 |
| 0.09567811 | 0.632029303 |
| 0.184560236 | 0.62114778 |
| 0.26857315 | 0.600420225 |
| 0.34765811 | 0.556295616 |
| 0.422040472 | 0.512042865 |
| 0.49296063 | 0.464842046 |
| 0.561839055 | 0.427357863 |
| 0.62991252 | 0.392337117 |
| 0.697450866 | 0.359996808 |
| 0.763918976 | 0.332161132 |

TABLE 4-continued

| Fractional height of rotating aerofoil blade | Optimum K value ($K_{rot\ opt}$) |
|---|---|
| 0.826696063 | 0.325568154 |
| 0.884643622 | 0.312334919 |
| 0.94136252 | 0.272280247 |
| 1 | 0.230049737 |

It will be appreciated by those skilled in the art that the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

What is claimed is:

1. An axial flow turbine comprising:

a low pressure turbine section; and a turbine exhaust system in axial flow series with the low pressure turbine section, the low pressure turbine section comprising:

a final low pressure turbine stage having a circumferential row of static aerofoil blades followed in axial succession by a circumferential row of rotating aerofoil blades, each aerofoil blade having a radially inner hub region and a radially outer tip region, wherein a K value, being equal to a ratio of a throat dimension (t) to a pitch dimension (p), of each static aerofoil blade varies along a height of the static aerofoil blade, between the hub region and the tip region, according to a substantially W-shaped distribution; and wherein the K value of each static aerofoil blade varies along the height of the static aerofoil blade between values $K_{stat\ min}$ and $K_{stat\ max}$ according to the substantially W-shaped distributions as follows:

| Fractional height of fixed aerofoil blade | Minimum K value ($K_{stat\ min}$) | Maximum K value ($K_{stat\ max}$) |
|---|---|---|
| 0 | 0.423985906 | 0.623985906 |
| 0.080855998 | 0.36638664 | 0.56638664 |
| 0.165294716 | 0.303545296 | 0.503545296 |
| 0.255880075 | 0.250207381 | 0.450207381 |
| 0.34182611 | 0.292337117 | 0.492337117 |
| 0.4154889 | 0.327357863 | 0.527357863 |
| 0.480483625 | 0.358649554 | 0.558649554 |
| 0.541802843 | 0.343071191 | 0.543071191 |
| 0.604115243 | 0.311514359 | 0.511514359 |
| 0.669284849 | 0.276224263 | 0.476224263 |
| 0.738563225 | 0.24037955 | 0.44037955 |
| 0.808859552 | 0.245298199 | 0.445298199 |
| 0.875782568 | 0.256737999 | 0.456737999 |
| 0.939306658 | 0.268124553 | 0.468124553 |
| 1 | 0.27945616 | 0.47945616. |

2. An axial flow turbine comprising:

a low pressure turbine section; and a turbine exhaust system in axial flow series with the low pressure turbine section, the low pressure turbine section comprising:

a final low pressure turbine stage having a circumferential row of static aerofoil blades followed in axial succession by a circumferential row of rotating aerofoil blades, each aerofoil blade having a radially inner hub region and a radially outer tip region, wherein a K value, being equal to a ratio of a throat dimension (t) to a pitch dimension (p), of each static aerofoil blade varies along a height of the static aerofoil blade, between the hub region and the tip region, according to a substantially W-shaped distribution; and wherein an optimum K value of each static aerofoil blade $K_{stat\ opt}$ varies along the height of the static aerofoil blade according to the substantially W-shaped distribution as follows:

| Fractional height of fixed aerofoil blade | Optimum K value ($K_{stat\ opt}$) |
|---|---|
| 0 | 0.523985906 |
| 0.080855998 | 0.46638664 |
| 0.165294716 | 0.403545296 |
| 0.255880075 | 0.350207381 |
| 0.34182611 | 0.392337117 |
| 0.4154889 | 0.427357863 |
| 0.480483625 | 0.458649554 |
| 0.541802843 | 0.443071191 |
| 0.604115243 | 0.411514359 |
| 0.669284849 | 0.376224263 |
| 0.738563225 | 0.34037955 |
| 0.808859552 | 0.345298199 |
| 0.875782568 | 0.356737999 |
| 0.939306658 | 0.368124553 |
| 1 | 0.37945616. |

3. An axial flow turbine comprising:

a low pressure turbine section; and a turbine exhaust system in axial flow series with the low pressure turbine section, the low pressure turbine section comprising:

a final low pressure turbine stage having a circumferential row of static aerofoil blades followed in axial succession by a circumferential row of rotating aerofoil blades, each aerofoil blade having a radially inner hub region and a radially outer tip region, wherein a K value, being equal to a ratio of a throat dimension (t) to a pitch dimension (p), of each static aerofoil blade varies along a height of the static aerofoil blade, between the hub region and the tip region, according to a substantially W-shaped distribution; and wherein the K value of each rotating aerofoil blade varies along the height of the rotating aerofoil blade between values $K_{rot\ min}$ and $K_{rot\ max}$ according to the distributions as follows:

| Fractional height of rotating aerofoil blade | Minimum K value ($K_{rot\ min}$) | Maximum K Value ($K_{rot\ max}$) |
|---|---|---|
| 0 | 0.533380873 | 0.733380873 |
| 0.09567811 | 0.532029303 | 0.732029303 |
| 0.184560236 | 0.52114778 | 0.72114778 |
| 0.26857315 | 0.500420225 | 0.700420225 |
| 0.34765811 | 0.456295616 | 0.656295616 |
| 0.422040472 | 0.412042865 | 0.612042865 |
| 0.49296063 | 0.364842046 | 0.564842046 |
| 0.561839055 | 0.327357863 | 0.527357863 |
| 0.62991252 | 0.292337117 | 0.492337117 |
| 0.697450866 | 0.259996808 | 0.459996808 |
| 0.763918976 | 0.232161132 | 0.432161132 |
| 0.826696063 | 0.225568154 | 0.425568154 |
| 0.884643622 | 0.212334919 | 0.412334919 |
| 0.94136252 | 0.172280247 | 0.372280247 |
| 1 | 0.130049737 | 0.330049737. |

4. An axial flow turbine comprising:

a low pressure turbine section; and a turbine exhaust system in axial flow series with the low pressure turbine section, the low pressure turbine section comprising:

a final low pressure turbine stage having a circumferential row of static aerofoil blades followed in axial succession by a circumferential row of rotating aerofoil blades, each aerofoil blade having a radially inner hub region and a radially outer tip region, wherein a K value, being equal to a ratio of a throat dimension (t) to a pitch dimension (p), of each static aerofoil blade varies along a height of the static aerofoil blade, between the hub region and the tip region, according to a substantially W-shaped distribution; and wherein are optimum K value of each rotating aerofoil blade $K_{rot\ opt}$ varies along the height of the rotating aerofoil blade according to the substantially W-shaped distribution as follows:

| Fractional height of rotating aerofoil blade | Optimum K value ($K_{rot\ opt}$) |
|---|---|
| 0 | 0.633380873 |
| 0.09567811 | 0.632029303 |
| 0.184560236 | 0.62114778 |
| 0.26857315 | 0.600420225 |
| 0.34765811 | 0.556295616 |
| 0.422040472 | 0.512042865 |
| 0.49296063 | 0.464842046 |
| 0.561839055 | 0.427357863 |
| 0.62991252 | 0.392337117 |
| 0.697450866 | 0.359996808 |
| 0.763918976 | 0.332161132 |
| 0.826696063 | 0.325568154 |
| 0.884643622 | 0.312334919 |
| 0.94136252 | 0.272280247 |
| 1 | 0.230049737. |

5. The axial flow turbine according to claim 1, wherein each static aerofoil blade comprises:

a trailing edge lean angle of between 16 degrees and 25 degrees.

6. The axial flow turbine according to claim 2, wherein each static aerofoil blade comprises:

a trailing edge lean angle of between 16 degrees and 25 degrees.

7. The axial flow turbine according to claim 5, wherein each static aerofoil blade comprises:

a trailing edge lean angle of about 19 degrees.

8. The axial flow turbine according to claim 6, wherein each static aerofoil blade comprises:

a trailing edge lean angle of about 19 degrees.

9. The axial flow turbine according to claim 2, wherein each static aerofoil blade comprises:

a plurality of radially adjacent aerofoil sections stacked on a straight line along a trailing edge of the static aerofoil blade.

10. The axial flow turbine according to claim 1, wherein the K value of each rotating aerofoil blade varies along the height of the rotating aerofoil blade between values $K_{rot\ min}$ and $K_{rot\ max}$ according to the distributions as follows:

| Fractional height of rotating aerofoil blade | Minimum K value ($K_{rot\ min}$) | Maximum K Value ($K_{rot\ max}$) |
|---|---|---|
| 0 | 0.533380873 | 0.733380873 |
| 0.09567811 | 0.532029303 | 0.732029303 |
| 0.184560236 | 0.52114778 | 0.72114778 |
| 0.26857315 | 0.500420225 | 0.700420225 |
| 0.34765811 | 0.456295616 | 0.656295616 |
| 0.422040472 | 0.412042865 | 0.612042865 |
| 0.49296063 | 0.364842046 | 0.564842046 |
| 0.561839055 | 0.327357863 | 0.527357863 |
| 0.62991252 | 0.292337117 | 0.492337117 |
| 0.697450866 | 0.259996808 | 0.459996808 |
| 0.763918976 | 0.232161132 | 0.432161132 |
| 0.826696063 | 0.225568154 | 0.425568154 |
| 0.884643622 | 0.212334919 | 0.412334919 |
| 0.94136252 | 0.172280247 | 0.372280247 |
| 1 | 0.130049737 | 0.330049737. |

11. The axial flow turbine according to claim 2, wherein the K value of each rotating aerofoil blade varies along the height of the rotating aerofoil blade between values $K_{rot\ min}$ and $K_{rot\ max}$ according to the distributions as follows:

| Fractional height of rotating aerofoil blade | Minimum K value ($K_{rot\ min}$) | Maximum K Value ($K_{rot\ max}$) |
|---|---|---|
| 0 | 0.533380873 | 0.733380873 |
| 0.09567811 | 0.532029303 | 0.732029303 |
| 0.184560236 | 0.52114778 | 0.72114778 |
| 0.26857315 | 0.500420225 | 0.700420225 |
| 0.34765811 | 0.456295616 | 0.656295616 |
| 0.422040472 | 0.412042865 | 0.612042865 |
| 0.49296063 | 0.364842046 | 0.564842046 |
| 0.561839055 | 0.327357863 | 0.527357863 |
| 0.62991252 | 0.292337117 | 0.492337117 |
| 0.697450866 | 0.259996808 | 0.459996808 |
| 0.763918976 | 0.232161132 | 0.432161132 |
| 0.826696063 | 0.225568154 | 0.425568154 |
| 0.884643622 | 0.212334919 | 0.412334919 |
| 0.94136252 | 0.172280247 | 0.372280247 |
| 1 | 0.130049737 | 0.330049737. |

12. The axial flow turbine according to of claim 2, wherein the optimum K value of each rotating aerofoil blade $K_{rot\ opt}$ varies along the height of the rotating aerofoil blade according to the distribution as follows:

| Fractional height of rotating aerofoil blade | Optimum K value ($K_{rot\ opt}$) |
|---|---|
| 0 | 0.633380873 |
| 0.09567811 | 0.632029303 |
| 0.184560236 | 0.62114778 |
| 0.26857315 | 0.600420225 |
| 0.34765811 | 0.556295616 |
| 0.422040472 | 0.512042865 |
| 0.49296063 | 0.464842046 |
| 0.561839055 | 0.427357863 |
| 0.62991252 | 0.392337117 |
| 0.697450866 | 0.359996808 |
| 0.763918976 | 0.332161132 |
| 0.826696063 | 0.325568154 |
| 0.884643622 | 0.312334919 |
| 0.94136252 | 0.272280247 |
| 1 | 0.230049737. |

* * * * *